United States Patent [19]

Bousaid

[11] Patent Number: 4,649,997

[45] Date of Patent: Mar. 17, 1987

[54] CARBON DIOXIDE INJECTION WITH IN SITU COMBUSTION PROCESS FOR HEAVY OILS

[75] Inventor: Issam S. Bousaid, Houston, Tex.

[73] Assignee: Texaco Inc., White Plains, N.Y.

[21] Appl. No.: 685,888

[22] Filed: Dec. 24, 1984

[51] Int. Cl.[4] ..... E21B 43/243

[52] U.S. Cl. ..... 166/261; 166/263

[58] Field of Search ..... 166/261, 263, 272, 260

[56] References Cited

U.S. PATENT DOCUMENTS

| | | | |
|---|---|---|---|
| 2,642,943 | 6/1953 | Smith et al. | 166/261 |
| 2,924,276 | 2/1960 | Heilman et al. | 166/261 |
| 3,036,632 | 5/1962 | Koch et al. | 166/256 |
| 3,285,336 | 11/1966 | Gardner | 166/261 |
| 3,344,856 | 10/1967 | Lange | 166/261 X |
| 3,375,870 | 4/1968 | Satter et al. | 166/261 |
| 3,563,312 | 2/1971 | Zwicky | 166/261 |
| 3,680,634 | 8/1972 | Peacock et al. | 166/261 |
| 3,770,398 | 11/1973 | Abraham et al. | 166/261 |
| 3,794,113 | 2/1974 | Strange | 166/245 |
| 3,872,924 | 3/1975 | Clampitt | 166/261 |
| 4,099,568 | 7/1978 | Allen | 166/269 |
| 4,393,934 | 7/1983 | Savins et al. | 166/261 |
| 4,415,031 | 11/1983 | Hunt, III | 166/261 |
| 4,429,745 | 2/1984 | Cook | 166/272 X |
| 4,436,344 | 3/1984 | Forgac et al. | 166/261 X |
| 4,474,237 | 10/1984 | Shu | 166/261 |

*Primary Examiner*—George A. Suchfield

*Attorney, Agent, or Firm*—Jack H. Park; Kenneth R. Priem; Harold J. Delhommer

[57] ABSTRACT

The invention process is a method of conducting in situ combustion in heavy oil or tar sand reservoirs wherein carbon dioxide is injected into the formation prior to, during, or prior to and during in situ combustion. The carbon dioxide may be injected concurrently with the injection of the oxygen-containing gas or the oxygen-containing gas and carbon dioxide may be injected in alternate slugs. The injection of carbon dioxide aids in situ combustion by lowering the viscosity of the oil, creating channels in the heavy oil deposits for the passage of the oxygen-containing gas and increasing the mobility of oil ahead of the combustion front.

6 Claims, No Drawings

CARBON DIOXIDE INJECTION WITH IN SITU COMBUSTION PROCESS FOR HEAVY OILS

BACKGROUND OF THE INVENTION

This invention concerns an oil recovery method for heavy oils and tar sands wherein carbon dioxide is injected prior to and during in situ combustion operations.

It is well recognized that primary hydrocarbon recovery techniques may recover only a portion of the petroleum in the formation. Thus, numerous secondary and tertiary recovery techniques have been suggested and employed to increase the recovery of hydrocarbons from the formations holding them in place. Thermal recovery techniques have proven to be effective in increasing the amount of oil recovered from the formation. Waterflooding and steamflooding have proven to be the most successful oil recovery techniques yet employed in commercial practice. Some successes have also been achieved with in situ combustion processes.

An in situ combustion process requires the injection of sufficient oxygen-containing gas to support and sustain combustion of the hydrocarbons in the reservoir. When the flow of the oxygen-containing gas in the reservoir is large enough, combustion will occur, either spontaneously or from another source such as a downhole heater. A portion of the oil is burned as fuel at the front which proceeds slowly through the reservoir, breaking down the oil into various components, vaporizing and pushing the lighter oil components ahead of the burning regions through the reservoir to the production wells. Some heavy oil formations can create problems for in situ combustion drives with a low permeability which makes it difficult to inject an oxygen-containing gas. A second problem which may also exist is the damping or the extinction of the combustion front caused by viscous oil banks.

Several methods have been suggested by the prior art to improve in situ combustion drives. U.S. Pat. No. 3,375,870 suggests injecting steam into a formation until breakthrough at the production wells, continuing to inject steam of a reduced steam quality and concluding with in situ combustion. U.S. Pat. No. 3,680,634 discloses the injection of water, hot water or steam prior to in situ combustion. U.S. Pat. Nos. 3,563,312 and 3,794,113 both disclose the injection of steam into a formation prior to in situ combustion. An additional reference, U.S. Pat. No. 4,099,568 suggests the injection of a non-condensable, non-oxidizing gas ahead of or in combination with steamflooding to reduce the tendency of viscous oil plugging during steam injection. U.S. Pat. No. 4,099,568, however, does not disclose the use of in situ combustion.

SUMMARY OF THE INVENTION

The present invention is an improved method of conducting in situ combustion in heavy oil or tar sand reservoirs wherein carbon dioxide is injected into the formation prior to, during or prior to and during in situ combustion. Optionally, a light hydrocarbon gas may also be injected with the carbon dioxide. The injection of carbon dioxide aids in situ combustion, particularly in heavy oil reservoirs and tar sands, by lowering the viscosity of the oil, creating channels in the heavy oil deposits for the passage of an oxygen-containing gas such as air and increasing the mobility of oil ahead of the combustion front.

DETAILED DESCRIPTION OF THE INVENTION

The injection of carbon dioxide into an underground hydrocarbon reservoir has a beneficial effect in improving mobility and viscosity of the underground hydrocarbons. This improvement in viscosity and mobility is particularly important when the underground reservoir contains highly viscous oils or tar sands. The carbon dioxide is able to dissolve within the viscous hydrocarbons decreasing the viscosity and allowing them to be more easily pushed through the formation by a variety of different driving mechanisms.

The injection of carbon dioxide into a hydrocarbon reservoir prior to the initiation of in situ combustion or during combustion improves the efficiency of the in situ combustion process. According to the invention, carbon dioxide can be injected prior to ignition of the oil formation in a slug form comprising about 25 to about 100 MCF of carbon dioxide per acre-foot of reservoir volume. Due to its ability to dissolve in the viscous hydrocarbons of the reservoir, the carbon dioxide will render the reservoir more susceptible to a successful in situ combustion project by decreasing the viscosity of the viscous oils or bitumen as well as providing channels within the reservoir matrix for continued injection of a combustion supporting gas such as air to reach into the formation. Air is the oxygen-containing gas of choice because of its ready availability and cost, but other gas mixtures containing oxygen may be employed.

In laboratory combustion tests, carbon dioxide dissolved in large amounts in heavy oils and tar sands allowing the viscous oil or bitumen to flow at room temperature. Test results show that most of the bitumen (8° API) produced during in situ combustion contained up to 60% by volume of dissolved gases, mostly carbon dioxide in solution with the bitumen at 75° F. and 300 psig. The mobility of the bitumen without carbon dioxide is practically nonexisting under such conditions. Therefore, the dissolved carbon dioxide in the produced liquid was the main contributor in mobilizing the bitumen during the tests.

It is preferred that the carbon dioxide be driven deeper into the reservoir by a slug of oxygen-containing gas such as air after the injection of the carbon dioxide. Once sufficient oxygen-containing gas has been injected into the reservoir, ignition follows. In most cases, it is desirable to allow the injected carbon dioxide to soak in the reservoir for about 2 to about 30 days prior to the following injection of the oxygen-containing gas, preferably, air.

Based on laboratory results, the soak volume prior to ignition of the injection well is determined from the equation $$CO_2\ \mathrm{Vol} = 178\phi S_{oi},\ \mathrm{MCF/Ac-Ft} \qquad (1)$$

where a porosity, $\phi$, and an initial oil saturation $S_{oi}$ of 0.41 and 0.69, respectively, were used in the test. The 8° API bitumen absorbed 43% of the total carbon dioxide volume injected at 75° F. and 300 psig during a 16 hour soak period. Based on the test results, the maximum carbon dioxide volume that can be injected may vary from about 50 to about 117 MCF per acre-foot of oil formation.

A second part of the invention concerns the co-injection of carbon dioxide with an oxygen-containing gas during the combustion drive. Although the carbon dioxide may be injected at a different point from the oxygen-containing gas, it is preferred that the carbon dioxide be injected simultaneously or intermittently with the oxygen-containing gas which supports combustion in the ratio of about 0.1 to about 0.5 volumes carbon dioxide to volumes of air. If enriched air containing a higher concentration of oxygen is used, the ratio of carbon dioxide to oxygen-containing gas may be higher. Carbon dioxide should be injected in the ratio of about 0.02 to about 0.1 volumes of carbon dioxide per volume of oxygen in the oxygen-containing gas.

This step is best initiated after the burning front has moved about 50 feet away from the injection well. The carbon dioxide flow rate should be limited to about 50% of the air flux when carbon dioxide and air are injected simultaneously or intermittently. The maximum carbon dioxide injection rate increases in proportion to the volume of oxygen injected.

An adequate supply of the oxygen-containing gas is important once combustion has been initiated. Thus, some care must be exercised to insure that the ratio of co-injected carbon dioxide to air is not raised beyond the 50% limitation for too long a period of time to avoid a harmful extinction of the combustion front. At all times, an adequate supply of oxygen-containing gas must be furnished to the combustion front. However, since hydrocarbon reservoirs retain heat very well, it is believed that a front could be extinguished for several days and then be immediately reignited upon the injection of a oxygen containing gas.

The volume of carbon dioxide injected in the continuous, or alternate injection embodiment is usually limited to a volume equal to the estimated $CO_2$-soak volume. In the continuous injection embodiment, carbon dioxide is injected in an amount up to the calculated $CO_2$-soak volume. Air injection alone is continued for about seven days to about sixty days, preferably, about thirty to about sixty days. Carbon dioxide is injected again concurrently with air up to the estimated $CO_2$-soak volume. Preferably, the cycle is repeated for a total of about three to about ten carbon dioxide injection steps.

The same carbon dioxide volumes can be introduced intermittently in slug form without air, but air injection or the oxygen-containing gas must be resumed within about five to about seven days in order to sustain combustion. In either case, the ultimate carbon dioxide volume injected need not exceed about three to about ten times the carbon dioxide volume used during the soak period calculated from Equation (1).

Optionally, a light hydrocarbon gas such as methane, ethane, propane and butane may be co-injected with the carbon dioxide and air to further improve the viscosity of the viscous underground hydrocarbons. Propane, butane and pentane are the preferred light hydrocarbon gases for co-injection with carbon dioxide alone or simultaneously with an oxygen-containing gas.

An igniter is preferably used to initiate the in situ combustion along with the injection of air. The igniter is removed from the formation after ignition. In cases where the formation temperature is high enough, the injection of a sufficient quantity of air may be enough to spontaneously ignite the combustion front without the use of an igniter.

Laboratory tests show that spontaneous ignition by air injection occurs at sandface temperatures of 150° F. and greater. A convenient ignition method in the field uses a steam slug at 450° to 500° F. prior to air injection. The steam volume injected at the sandface is approximately 20 to 30 barrels of cold water equivalent steam per foot of oil pay thickness. This ignition technique is best suited for shallow reservoirs up to 1000 feet deep. A larger steam volume is used for deeper reservoirs in order to compensate for the wellbore heat losses prior to the injection phase.

After a stable in situ combustion front has propogated approximately 50 feet from the air injection well, a wet in situ combustion process is preferably initiated by commingling the injected air with water. The water/air ratio, WAR, should initially be in the range of about 0.10 barrels of water per 1,000 cubic feet of air to about 0.40 barrels of water per 1,000 cubic feet of air.

The amount of commingled water injected should be gradually increased from the initial ratio to the maximum WAR prior to combustion floodout near the end of the process. As a general guideline, a dry forward combustion is allowed to progress about 50 feet from the injection well before water is co-injected with air at the initial WAR of about 0.1 to about 0.4 barrels of water per MCF air. About 50% of the reservoir volume should be burned by the in situ combustion front prior to increasing the water/air ratio to its maximum value.

Optionally, the process may be continued with floodout injection for quenched combustion. This should occur prior to or at the time the steam plateau reaches the producing wells. The steam plateau is the steam zone pushed ahead of the in situ combustion front. The increase in the water/air ratio should preferably follow a linear increase. Laboratory experiments have consistently shown greater oil recoveries and improved thermal efficiency from wet in situ combustion done under the above guidelines than with dry forward combustion. Wet combustion provides a shorter project life and reduces air and fuel requirements by about 20% over dry in situ combustion.

The following field example will further illustrate the novel carbon dioxide and in situ combustion process of the present invention. This example is given by way of illustration and not as a limitation on the scope of the invention. Thus, it should be understood that the process may be varied to achieve similar results within the scope of the invention.

EXAMPLE

A hydrocarbon-containing reservoir at a depth of 450 feet has a net sand thickness of 32 feet and a porosity of 38%. The sand formation is saturated with a viscous crude oil of 18° API gravity and 850 cp viscosity. Due to poor mobility of the oil, the oil saturation is 74 percent which is near its initial value at a reservoir temperature of 82° F. and pressure equal to about atmospheric pressure.

The field is developed on an irregular well spacing, but the pilot is an inverted five-spot pattern encompassing an area of 2.5 acres. The pilot pattern is representative of the producing sand in which carbon dioxide and in situ combustion is to be applied. Since heavy oils lend themselves favorably to thermal recovery, plans provide for an in situ combustion drive combined with carbon dioxide injection to flood the 80 acre-foot pilot pattern. This recovery process consists of carbon dioxide injection prior to ignition of the oil, a carbon dioxide soak period, and also carbon dioxide injection with air either continuously or intermittently.

The volume of carbon dioxide injected prior to ignition of the oil formation is 4 million cubic feet using the average value of 50 MCF per acre-foot. This carbon dioxide volume is obtained from Equation 1.

$$\text{Vol } CO_2 = 178\phi S_{oi} = 50 \text{ MCF/Ac-Ft} \quad (1)$$

This is a minimum slug requirement for a soak period lasting up to 72 hours. A slug volume of twice that value or 8 MMCF is to be introduced at the injection well and allowed to soak a minimum of 7 days for maximum carbon dioxide dissolution into the oil. All pattern wells are shut in, or placed on restricted production during the soak period.

The ignition phase is initiated by heating the sandface at the injection well to temperatures in excess of 500° F. using a low air flow rate. The sand volume for a radius of several feet is usually affected by such heating. The sandface temperature is raised by a downhole heater or by the injection of hot fluids such as steam since spontaneous ignition by air injection is unlikely at 82° F. The air rate is then increased and a combustion front is established near the wellbore.

The injected air rate is further increased to propogate a burning zone at a desirable rate of about one-half foot per day. This frontal advance is usually an optimum rate and is held constant until the front reaches about 30 to 50 feet away from the injection well. Beyond this distance, the combustion front velocity $v_f$ is limited by the air injection rate, $Q_{air}$, which is directly related to the effective air flux, $F_{air}$, at the front. This relationship is given by the equation:

$$F_{air} = \frac{Q_{air}}{48\pi\,(h)r}, \; SCF/(\text{hr-ft}^2) \quad (2)$$

where the net sand thickness, h, and the radial distance to the front, r, are expressed in feet.

The injection rate, $Q_{air}$ in SCF per day, is controlled to yield an air flux at a selected radial distance for average front velocity of 0.5 feet per day. The air requirement, AIR, for dry combustion is 260 SCF of air consumed per cubic foot of reservoir rock. Thus, the limiting air flux is calculated from Equation 3:

$$F_{air} = \frac{\text{AIR}}{E_s}\left(\frac{v_f}{24}\right), \; SCF/\text{hr-ft}^2 \quad (3)$$

where $v_f$ is the front velocity and the term AIR is increased to allow for sweep efficiency, $E_s$, within the pattern. Using a 70% sweep, the limiting air flux for a frontal velocity of 0.5 feet per day is $$F_{air} = \frac{260}{0.7}\left(\frac{0.50}{24}\right) = 7.74$$

and the maximum air injection rate from Equation 2 at a distance of 30 feet from the sandface becomes $$Q_{air} = 48\pi(32)(30)7.74 = 1120 \text{ MCF/day.}$$

The maximum air rate required is 1.12 MMCF per day to achieve a burning front velocity of 0.5 feet per day up to 30 feet distance from the injection well. At a greater front distance, the rate of advance decreases linearly with a decrease in $F_{air}$ as expressed from Equations (2) and (3).

$$Q_{air} = 48\,\pi(h)r\,F_{air} \quad (4)$$

$$Q_{air} = 48\,\pi(h)r\left(\frac{\text{Air}}{E_s}\right)\left(\frac{v_f}{24}\right), \; SCF/\text{day}$$

Substituting the proper values in Equation (4), the front velocity $$v_f = 15/r, \text{ ft/day} \quad (5)$$

decreases to 0.15 and 0.10 feet per day at 100 and 150 foot distances, respectively. The distance to the producing wells is 233 feet for the 2.5 acre, inverted five-spot well pattern.

Carbon dioxide injection is resumed after the front reaches 30 feet from the sandface at a ratio limited to about 50% of the air injection rate. Two injection schemes proposed for the 2.5 acre pattern are described below.

The first schedule requires continuous carbon dioxide/air injection by maintaining a daily air injection rate of 1120 MCF at all times and a carbon dioxide injection rate initiated at 100 MCF and increased up to a maximum of 560 MCF per day. The initial carbon dioxide/air injection cycle is to be continued until 8 MMCF of carbon dioxide has been injected within a 30 day period. This carbon dioxide volume is equal to the carbon dioxide slug volume injected prior to ignition for the soak period. The same carbon dioxide injection cycle may be repeated after another 30 to 60 days with air being injected between the carbon dioxide injection cycles. An optimum of about three to about ten cycles can be applied per pattern, in this case, 5 cycles to be used over a period of one year of injection.

The alternate scheme combines carbon dioxide with air injection by alternating carbon dioxide alone followed by air injection alone. The carbon dioxide slug is injected after air injection is stopped, for a maximum period of about seven days, preferably, a shorter time, using 50% of the air injection rate or 560 MCF of carbon dioxide per day. carbon dioxide injection is stopped and air injection is resumed at the constant rate of 1120 MCF per day for a period of 14 days, thus completing the 21 day cycle. This schedule of alternating carbon dioxide and air uses about one-half the carbon dioxide volume injected per cycle compared to the continuous scheme described above. The same carbon dioxide volume, however, can be injected in about 10 cycles over a period of 7 months instead of the 12 month period for the continuous injection scheme.

The alternating carbon dioxide/air schedule is selected for the 2.5 acres pattern because of the shorter time required for injecting the total carbon dioxide volume of 40 MMCF. The benefit of carbon dioxide is greater during the early phase of injection when the oil sand temperature is relatively lower and carbon dioxide is more readily soluble in the oil.

In order to achieve the maximum benefit of this process of this invention it is decided to start wet combustion after the first carbon dioxide/air injection cycle is completed. Water is co-injected with air at an initial water to air ratio, WAR, of 100 barrels per million cubic feet of air. The WAR is gradually increased during each successive cycle until a maximum WAR of 400 barrels of water per MMCF of air is reached during the tenth cycle. Beyond this time, only water and air are injected at a daily rate of 448 barrels and 1.12 MMCF, respectively.

One option considered for improved miscibility between the carbon dioxide and oil is to concurrently inject small quantities of light hydrocarbons such as $C_1$ and $C_2$ components and solvents $C_3$ through $C_5$ with the carbon dioxide. Such mixtures enhance the gas-oil solubility during the soak cycle and also during the carbon dioxide/air cycles after ignition. In this case, however, only carbon dioxide is used with the wet combustion process to flood the pilot pattern.

Another option is to waterflood the oil sand when steam first breaks through at the producing wells. This step is used toward the end of the project which speeds up production and recovers additional oil mobilized by the residual heat scavenged by the injected water.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. In a method fo recovering hydrcarbons by injecting an oxygen-containing gas to form an in situ combustion front in an underground reservoir penetrated by at least one injection well and at least one production well, the improvement comprising:

injecting about 25 MCF to about 117 MCF carbon dioxide per acre-foot of reservoir volume into the reservoir prior to ignition of the combustion front;

injecting an oxygen-containing gas into the reservoir;

igniting the reservoir to form a combustion front while continuing the injection of the oxygen-containing gas at an injection rate sufficient to propagate the combustion front a distance of up to one-half foot per day;

ceasing the injection of oxygen-containing gas for a period of up to about seven days while injecting about 25 MCF to about 117 MCF carbon dioxide per acre-foot of reservoir volume into the reservoir; and resuming the injection of oxygen-containing gas into the reservoir.

2. The method of claim 1, further comprising:

alternately injecting slugs of carbon dioxide without an oxygen-containing gas, and slugs of oxygen-containing gas without carbon dioxide after resuming the injection of oxygen-containing gas into the resrvoir, said carbon dioxide slugs being injected in the amount of about 25 MCF to about 117 MCF carbon dioxide per acre-foot of reservoir volume in less than about seven days.

3. The method of claim 1, wherein about three to about ten slugs of carbon dioxide are injected into the reservoir.

4. In a method of recovering hydrocarbous by injecting an oxygen-containing gas to form an in situ combustion front in an underground reservoir penetrated by at least one injection well and at least one production well, the improvement comprising:

injecting into the reservoir about 25 MCF to about 117 MCF carbon dioxide per acre-foot of reservoir volume prior to ignition of the combustion front;

allowing the carbon dioxide to soak in the reservoir for about two to about thirty days;

injecting air into the reservoir;

igniting the reservoir to form a combustion front;

concurrently injecting carbon dioxide and air into the reservoir in the ratio of about 0.1 to about 0.5 volumes of carbon dioxide per volume of air until a total of about 25 MCF to about 117 MCF carbon dioxide per acre-foot of reservoir have been injecting;

ceasing injection of carbon dioxide and continuing air injection for a period of about seven to about sixty days;

repeating the above two steps of concurrently injecting carbon dioxide and air, and ceasing injection of carbon dioxide and continuing air injection for about one to about eight additional cycles.

5. The method of claim 4, further comprising the steps of:

injecting water concurrently with the air after the combustion front has traveled about fifty feet from the injection well, said water being coinjected at the rate of about 100 barrels per million cubic feet of air;

increasing the rate of coinjected water during each of said cycles until a maximum water injection rate of about 400 barrels of water per million cubic feet of air is reached.

6. In a method of recovering hydrocarbons by injecting an oxygen-containing gas to form an in situ combustion front in an underground reservoir penetrated by at least one injection well and at least one production well, the improvement comprising:

injecting about 25 MCF to about 117 MCF carbon dioxide per acre-foot of resevoir volume into the reservoir; and allowing the injected carbon dioxide to soak in the reservoir for about 2 to about 30 days prior the injection of an oxygen containing gas and ignition of the combustion front.

* * * * *